US005769592A

United States Patent [19]

Christenson

[11] Patent Number: 5,769,592

[45] Date of Patent: Jun. 23, 1998

[54] CONTAINER GRABBING DEVICE

[75] Inventor: Ronald E. Christenson, Parsons, Tenn.

[73] Assignee: McNeilus Truck and Manufacturing, Inc., Dodge Center, Minn.

[21] Appl. No.: 716,999

[22] Filed: Sep. 20, 1996

[51] Int. Cl.[6] ..... B65F 3/02

[52] U.S. Cl. ..... 414/408; 414/421; 414/555; 294/902

[58] Field of Search ..... 414/406, 408, 414/486, 555, 421, 739; 294/902

[56] References Cited

U.S. PATENT DOCUMENTS

| | | | |
|---|---|---|---|
| 3,875,983 | 4/1975 | Kurelek | 414/739 X |
| 3,954,194 | 5/1976 | Stedman | 414/555 |
| 4,401,407 | 8/1983 | Breckenridge | 414/408 |
| 4,461,607 | 7/1984 | Smith et al. | 414/406 |
| 4,669,940 | 6/1987 | Englehardt et al. | 414/409 |
| 5,026,104 | 6/1991 | Pickrell | 294/86.4 |
| 5,391,039 | 2/1995 | Holton | 414/408 |
| 5,398,983 | 3/1995 | Ahrens | 294/106 |
| 5,419,671 | 5/1995 | Smith et al. | 414/421 |
| 5,547,332 | 8/1996 | Smith et al. | 414/786 |
| 5,562,386 | 10/1996 | Browning | 414/408 |
| 5,577,877 | 11/1996 | Smith et al. | 414/555 X |
| 5,601,392 | 2/1997 | Smith et al. | 414/408 |

*Primary Examiner*—James W. Keenan
*Attorney, Agent, or Firm*—Haugen and Nikolai, P.A.

[57] ABSTRACT

Vehicle mounted container handling devices include a rotating swivel mount, an articulated arm connected to the swivel mount, a support member rotationally connected to a free end of the articulated arm and a loading mechanism pivotally connected to the support member. The articulated arm, swivel mount and loading mechanism are operable between stowed, extended, lift and dump positions. The loading mechanism includes first and second opposed mechanized fingers pivotally connected to the support member and aligned in spaced relation to converge and diverge to grasp and release an object of interest. Each mechanized finger includes a belt that enhances the gripping ability of the loading mechanism. In operation, with the grasping device opened, the articulated arm is extended to reach out toward a container of interest. The swivel mount is operated to pivot the articulated arm as required for the loading mechanism to engage the container. The articulated arm is operated further to lift and dump the container in the vehicle above the swivel mount.

9 Claims, 8 Drawing Sheets

CONTAINER GRABBING DEVICE

BACKGROUND OF THE INVENTION

I. Field of the Invention

This invention relates generally to devices and methods for grabbing, lifting, and tipping (unloading) refuse and/or recyclables from collection containers into charging compartments of collection vehicles. More particularly, this invention relates to a grabbing device attached to an articulated arm mounted on a collection vehicle, which allows containers of varying shapes and sizes to be efficiently handled during collection efforts. The system coordinates a packer contained within the charging hopper of the collection vehicle which may be cycling continuously and repeatedly packing the refuse and/or recyclables.

II. Discussion of the Related Art

Various vehicles dedicated to the collection of refuse or recyclables have included a mechanized material handling device, allowing the operator to grab, lift, and empty a container of interest without getting out of the collection vehicle. Unless it is a forklift type system, the holding or grasping device is generally connected to an arm or extensible boom which is connected to a base mounted on the vehicle. The arm or boom and grasping device are operated in concert to engage the container of interest, lift, and dump the container into a receiving hopper in the vehicle.

A representative example of such a device appears in U.S. Pat. No. 5,391,039, issued to Holtom, which describes a grabber assembly attached to a refuse loader arm. The refuse loader arm includes a lift limb and a reach limb articulated to one another at a pivot point. The grabber assembly requires several independent actuators all of which must be operable in order to actuate the grabber assembly to a converging position. The several independent actuators further operate sequentially and each require pressure sensors for effective operation, all of which increases the complexity of the system and the cost to manufacture the grab assembly. Also, the '039 grabber assembly and loader arm arrangement do not provide for lateral movement of the grabber assembly, requiring the vehicle to be positioned directly alongside the container such that the container is aligned with the vertical pivoting plane of the arm.

U.S. Pat. No. 5,398,983, issued to Ahrens, describes a gripping apparatus for picking up containers. The gripping apparatus includes a frame with a pair of convergent arms pivotally mounted to the frame. Each arm is provided with a corresponding flexible element designed to address a container of interest. Each flexible element is attached at one end to the arm and at the other end to a lug attached to the frame at a position away from the pivotal axis of each arm. Each arm is pivoted independently by a respective hydraulic or pneumatic ram towards and away from each other. The rams are preferably operated simultaneously, requiring coordinated interconnection of the hydraulic or pneumatic rams.

A gripping apparatus having a single actuating means is disclosed in U.S. Pat. No. 4,461,607, issued to Fred T. Smith. The gripping apparatus disclosed by Smith includes a frame and grabber arms rotatably attached to the frame and rotated by a single hydraulic cylinder. A gear segment is coupled to each grabber arm, whereby the gear segments are in meshing relation. One end of the hydraulic cylinder is attached to one of the gears near the rotational axis, while the other end of the cylinder is attached to the frame. In this manner, a single hydraulic cylinder pivots the associated arms.

A need clearly exists for a simplified but sophisticated gripping device that may be positioned and operated laterally relative to a container of interest, wherein the fingers of the gripping device are actuated simultaneously by a single actuating means, and further wherein the fingers include a gripping belt that is unlikely to become entangled and jammed. The present invention meets these needs.

SUMMARY OF THE INVENTION

The purpose of the present invention is to provide a vehicle mounted grab, lift and dump mechanism that is preferably rotatably and pivotally mounted with reference to a material receiving location of a collection vehicle. The device includes a mechanized swivel mount, an articulated arm, a convergent digital gripping mechanism or grabber with flexible gripping belts, and mechanized systems for actuating each of the swivel mount, articulated arm, and grabber.

The swivel mount is rotatably attached to the collection vehicle to provide horizontal displacement. The swivel mount includes a base plate attached to the frame of a vehicle and upper and lower parallel pivot plates attached to the base plate and carrying a pivot shaft or pivot pin therebetween. The articulated arm includes first and second arm members joined or articulated to one another, wherein the first arm member is coupled to a swivel mount of the collection vehicle, and the second arm member has a free end attached to the gripping or grasping mechanism. The articulated arm pivots in a generally vertical plane and the swivel mount provides movement in a generally horizontal plane to provide a wide operating range for a grab, lift and dump function.

The articulated arm and swivel mount are described in greater detail in co-pending application Ser. No. 08/596,648, filed Feb. 5, 1996, and assigned to the same assignee as the present application, the entire disclosure of which is incorporated herein by reference. Those skilled in the art will appreciate that the articulated arm may be coupled to the collection vehicle via a sliding rail to accomplish fore and aft adjustments. The details of one such slide rail are more fully disclosed in co-pending application Ser. No. 08/664,593 filed Jun. 17, 1996, and assigned to the same assignee as the present application, the entire disclosure of which is incorporated herein by reference.

The gripping mechanism of the present invention includes a support member or frame, first and second opposed mechanized fingers, pivot pins, first and second flexible belts, guide rollers, belt guides and means for simultaneously actuating said first and second fingers. The support member is rotationally connected by known means to the free end of the mechanized arm. Each mechanized finger is pivotally connected to the support member. The fingers are shaped to fit around containers of a plurality of different shapes, including curved, rectangular, hexagonal and others.

The fingers are pivoted between an open or retracted position and a closed or grasping position by a fluid-operated actuator. The fluid-operated actuator, such as a double acting hydraulic cylinder, is pivotally connected between one of the fingers and the support member, whereby actuation of the hydraulic cylinder rotates the connected finger. Gear segments connected to proximal end of each finger are enmeshed together such that actuation of the hydraulic cylinder cause both fingers to rotate simultaneously either converging or diverging with respect to the other. A corresponding gripping belt is fastened to each finger to provide a flexible gripping surface and is provided with a guide to reduce the chance of entanglement.

In operation, at the beginning of a lift and dump cycle the articulated arm and gripping mechanism are in an "as stowed" or open position. Then the articulated arm is extended to move the gripping mechanism toward the container of interest. The swivel mount is pivoted in conjunction with the extension of the articulated arm to move the gripping device into engagement with the container of interest. The gripping device is operated to a closed position converging the fingers together to grab the container. Once the fingers engage the container, the articulated arm is operated generally vertically to lift and tip or invert the container and empty the contents into a receiving hopper of the collection vehicle. During the lifting and dumping operation, the swivel mount need not be operated since the arm and gripping mechanism tilt the container above the swivel mount regardless of the selective rotational position of the swivel mount.

OBJECTS

It is accordingly a principle object of the present invention to provide an improved gripping and lifting device for handling objects or containers of interest.

Another object of the invention is to provide a relatively simple gripping and lifting device attached to a vehicle which eliminates the need for precise positioning of the vehicle and allows for the efficient handle of various sized and shaped objects of interest.

Still another object of the invention is to provide a mechanized gripping device having a flexible belt for gripping that is less likely to jam and become entangled with the mechanism.

These and other objects, as well as these and other features and advantages of the present invention will become readily apparent to those skilled in the art from a review of the following detailed description of the preferred embodiment in conjunction with the accompanying drawings and claims and in which like numerals in the several views refer to corresponding parts.

DETAILED DESCRIPTION

Figure 1:
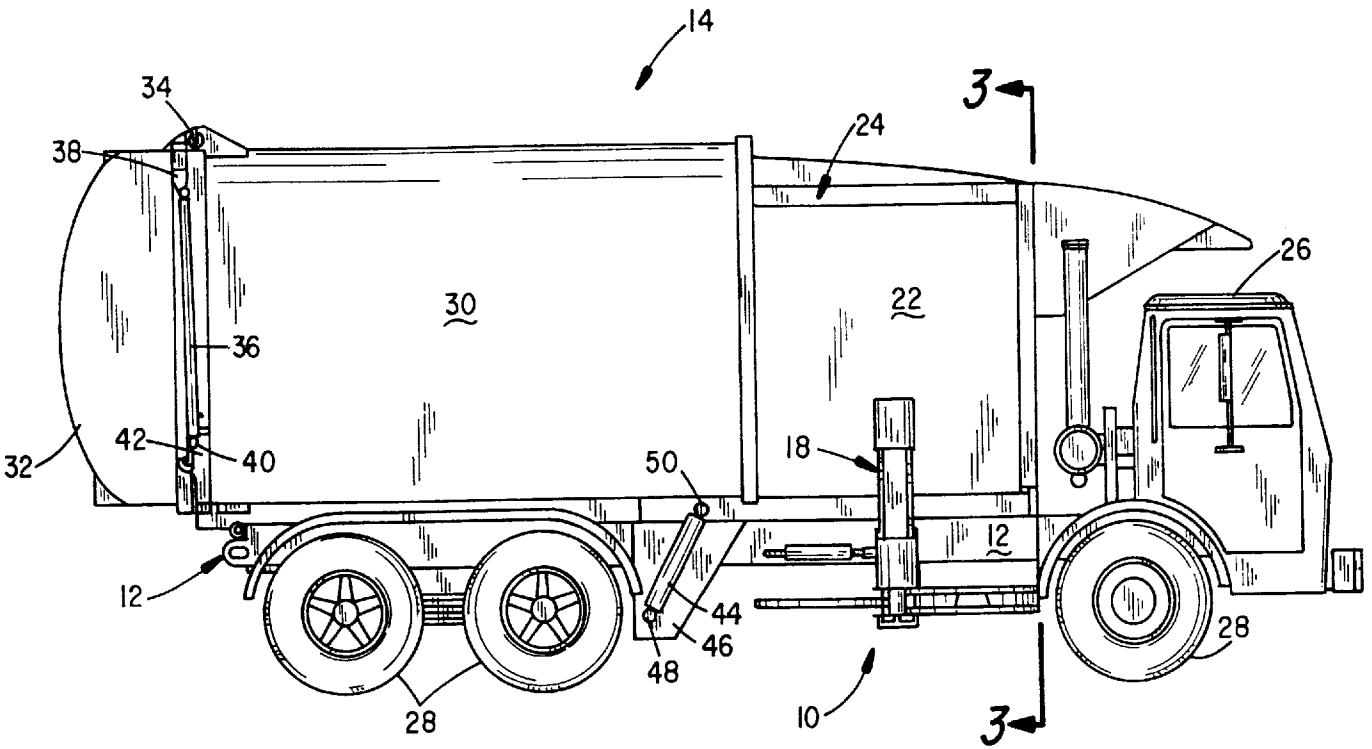
FIG. 1 is a side elevational view of a refuse collection vehicle equipped with a lifting device according to the invention.
Figure 2:
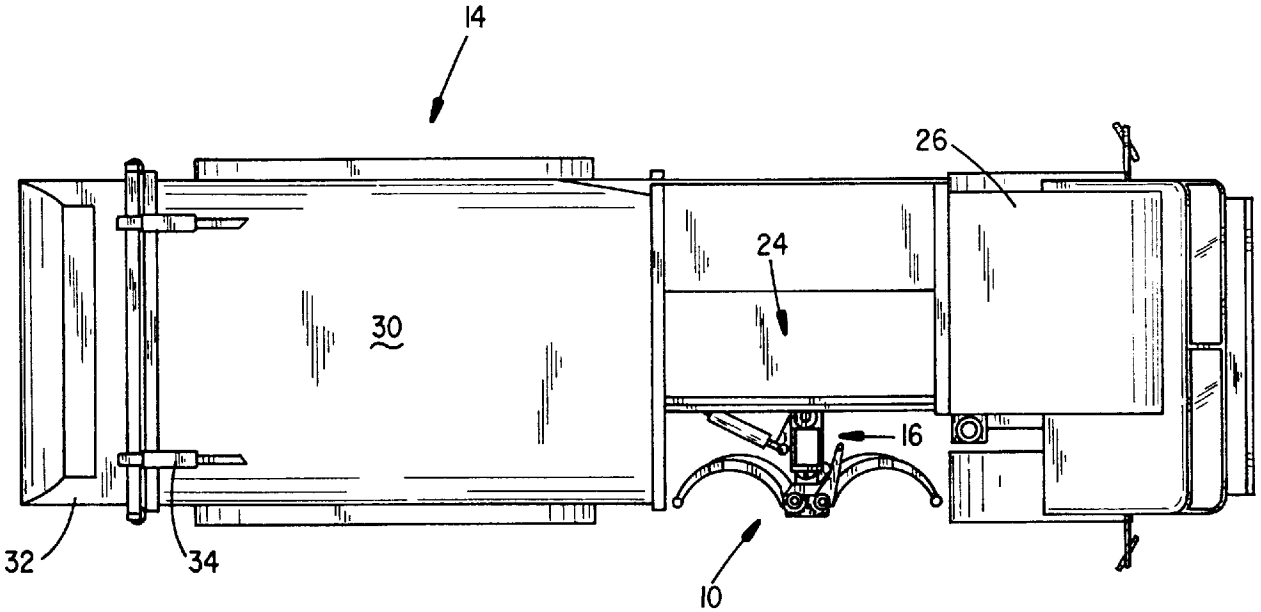
FIG. 2 is a top view of the refuse collection vehicle of the type shown in FIG. 1.
Figure 3:
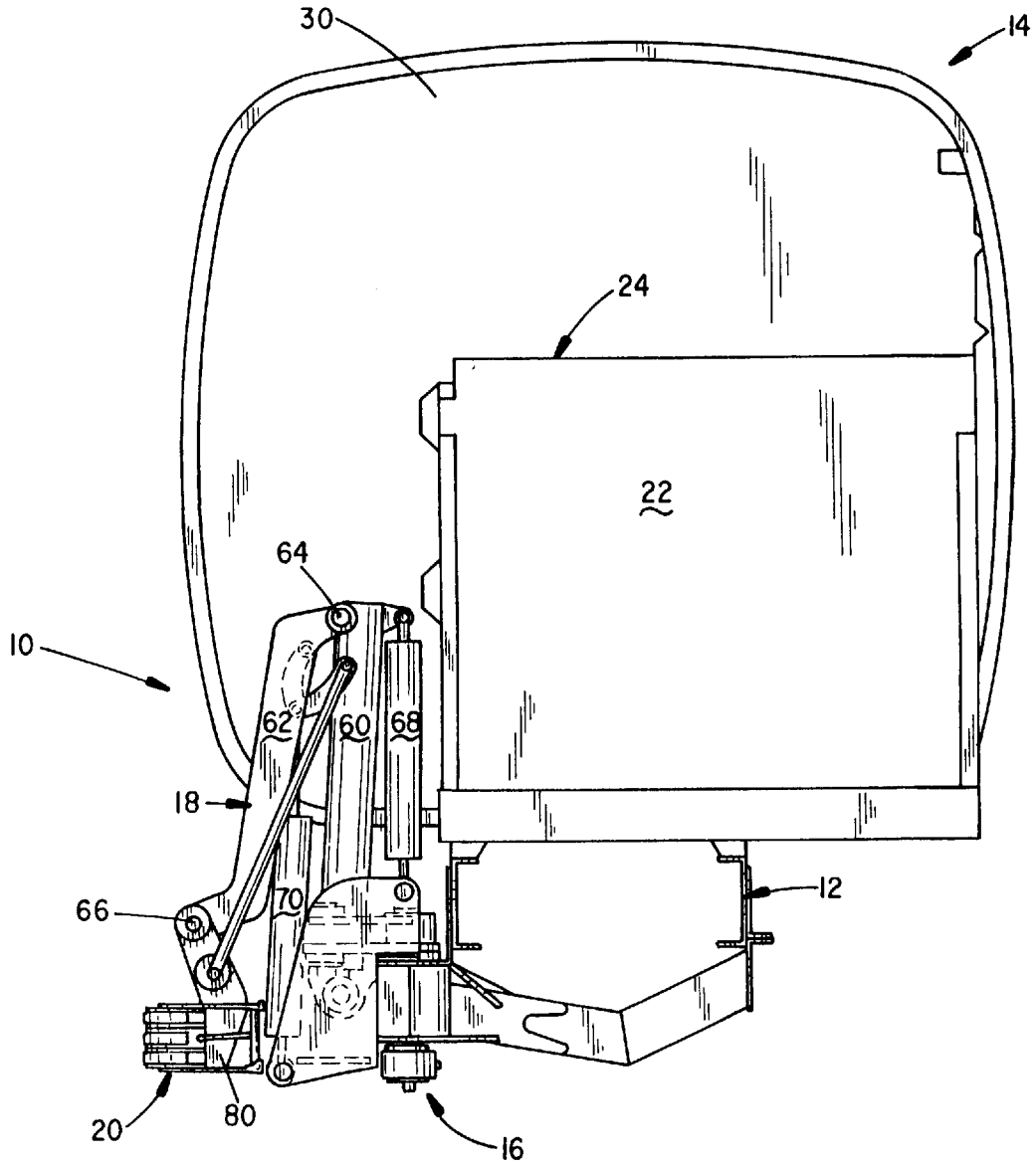
FIG. 3 is a cross-sectional view of the collection vehicle taken substantially along line 3—3 of FIG. 1.
Figure 4:
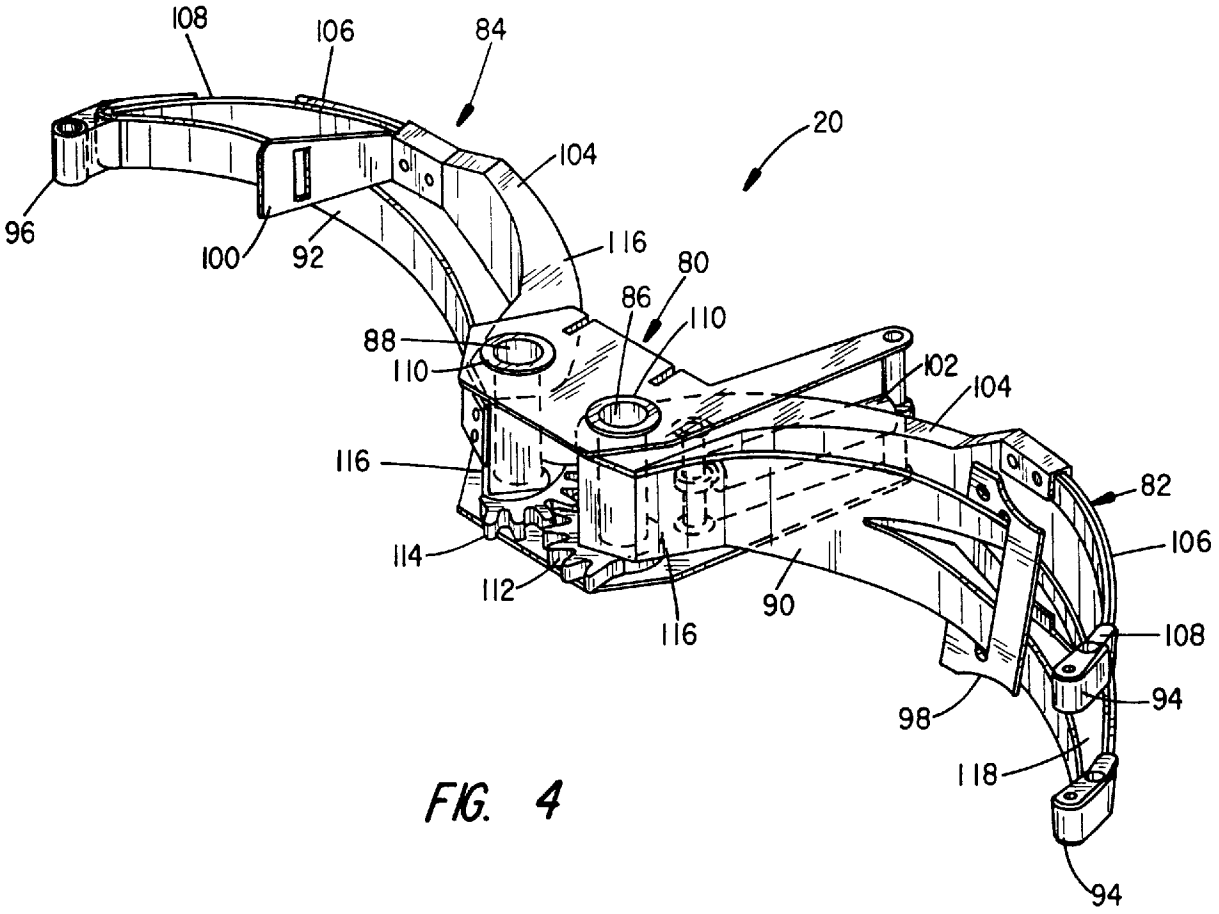
FIG. 4 is a perspective view of the grasping device in the open or stowed position removed from the articulated arm.
Figure 5:
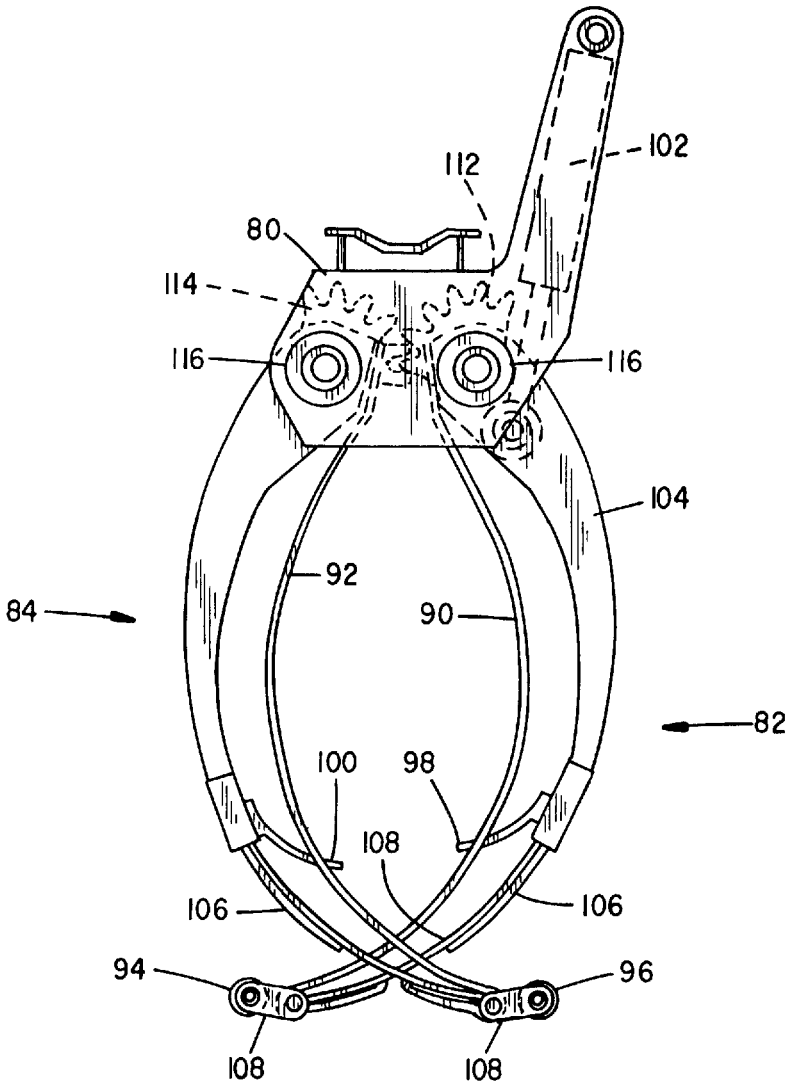
FIG. 5 is a top plan view of the grasping device in the closed or grasping position removed from the articulated arm.
Figure 6:
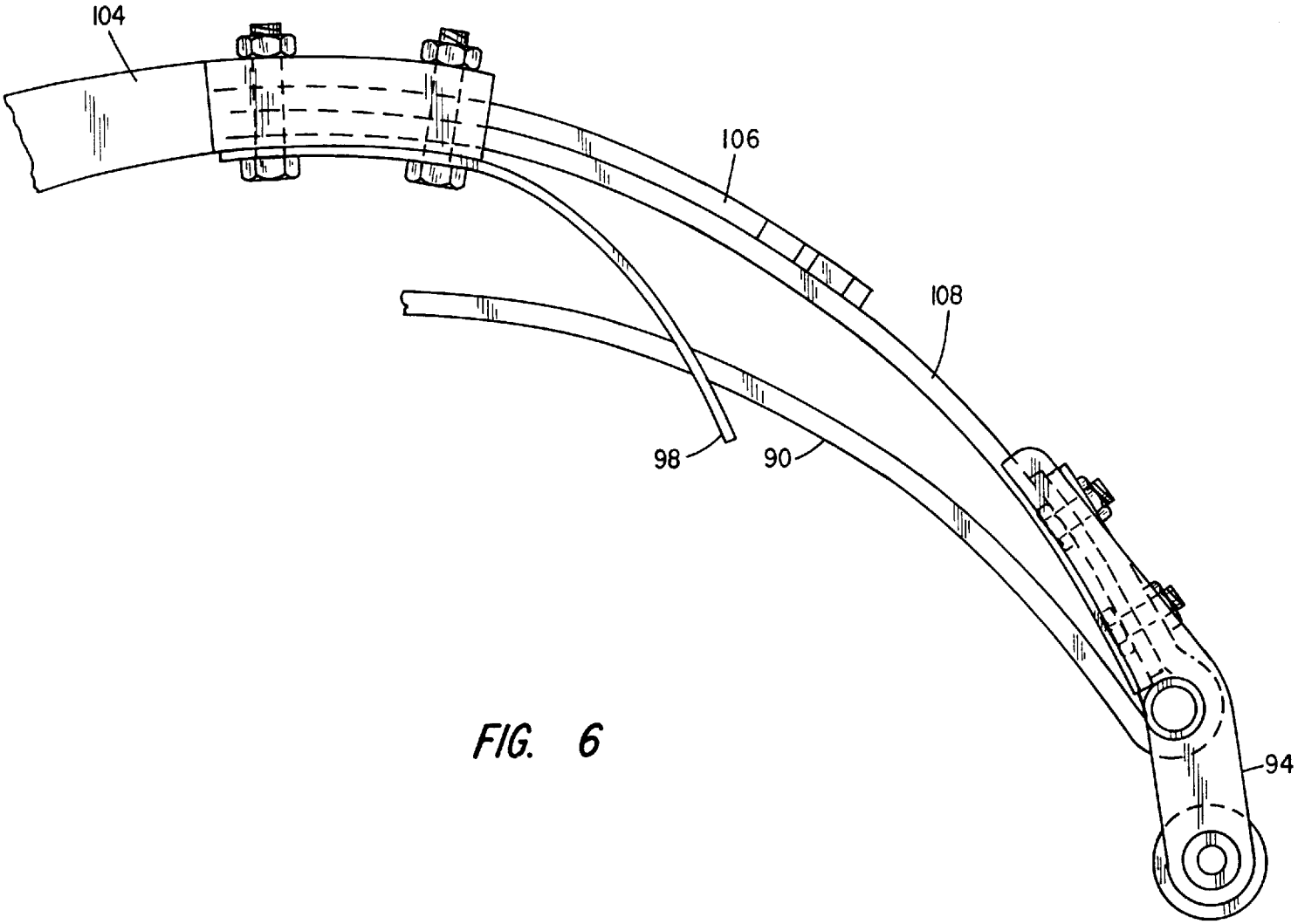
FIG. 6 is a greatly enlarged fragmentary top plan view of the first finger and first belt.
Figure 7:
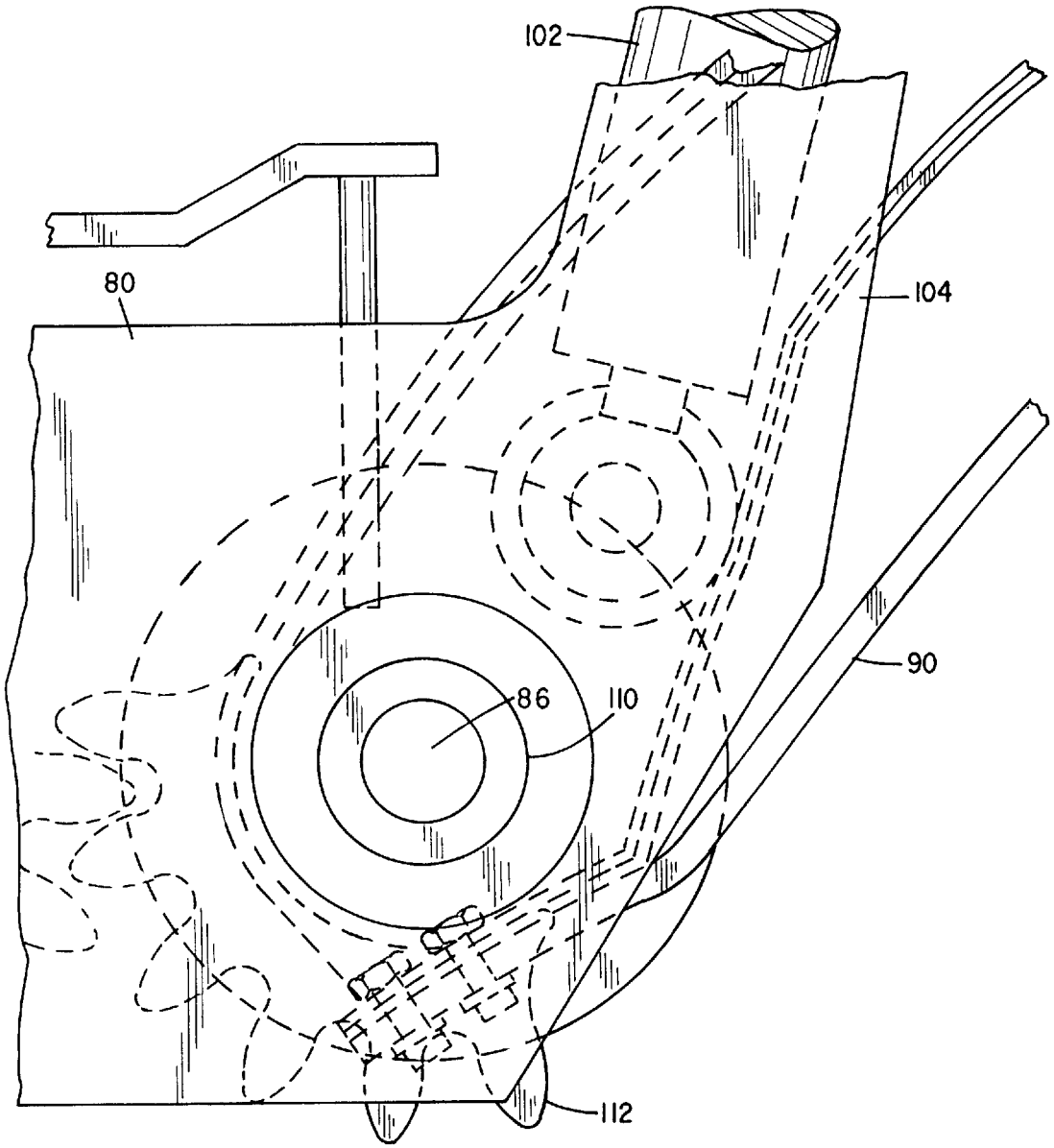
FIG. 7 is a greatly enlarged fragmentary top plan view of the mechanism for coupling the fingers for simultaneous rotation.

Referring first to FIGS. 1–3, the collection system 10 of the present invention is shown mounted to the chassis or frame 12 of a side loading collection vehicle 14. The collection system 10 includes a swivel mount 16, articulated arm 18 and gripping mechanism or grabber 20. The swivel mount 16 is attached to the chassis 12 next to a recess of a refuse receiving or charging hopper 22 which includes a top opening 24 for receiving recyclables and/or refuse.

The articulated arm 18 is pivotally connected to the swivel mount 16 at one end and to the grabber 20 at the other end. The swivel mount 16 enables the position of the articulated arm 18 and grabber 20 to be adjusted back and forth along the length of the collection vehicle 14 to accommodate the position of a container of interest. The grabber 20 and articulated arm 18 cooperate to empty selected containers into the charging hopper 22 through opening 24. The collection vehicle 14 need not be aligned with the container of interest for grasping and tilting.

The refuse vehicle 14 includes the usual cab 26 and wheels 28 which carry a storage body 30 connected to the charging hopper 22. Storage body 30 includes a tailgate 32 which is pivotally attached by a pair of vertically displaceable hinges 34, mounted at the top of the storage body 30. The tailgate 32 is operated between an open and a closed position by a pair of hydraulic cylinders, one of which is shown at 36, which are pivotally attached to the tailgate 32, as at 38, and to the storage body 30 as at 40. Side latches 42 are provided for latching the tailgate 32 to the storage body 30 in a well-known manner. The storage body is designed to tilt in conjunction with the opening of the tail gate to discharge refuse. Tilting is accomplished by a pair of side mounted hydraulic lift cylinders 44 that are pivotally attached to the frame by structural member 46 at 48 and to the storage body 30 at 50.

As recognized above, the swivel mount 16 and articulated arm 18 are described in greater detail in co-pending application Ser. No. 08/596,648 filed Feb. 5, 1996, the entire disclosure of which has been incorporated herein by reference. In general, the articulated arm 18 includes a pair of connected generally vertically pivotal articulated members including a first or inner lift arm member 60 pivotally attached to the swivel mount 16 and a second or outer lift arm member 62 pivotally attached to the first lift arm member 60 at joint 64. A support member or frame 80 of the gripping mechanism or grabber 20 is pivotally attached to the outer lift arm member 62 at 66. The articulated arm 18 may be operated by hydraulic cylinders 68 and 70 to extend the arm 18 for grasping the container of interest and lifting and dumping the container into the refuse charging hopper 22. Of course, the lift arm 18 is not limited to the embodiment shown which is merely exemplary and may be any suitable lift arm attached to the swivel mount 16.

Referring now to FIGS. 4–7, attention is next directed to the details of the grabber 20. The grabber 20 includes support member 80, first and second opposed compound fingers 82 and 84 respectively, pivot pins 86 and 88, first and second flexible belts 90 and 92, guide rollers 94 and 96, belt guides 98 and 100 and actuator 102.

Each compound finger 82 and 84 comprises a finger base, intermediate or middle, and tip segments 104, 106, and 108 respectively. Without limitation, the middle and tip segments may be manufactured from spring steel while the finger base 104 may be manufactured from a conventional steel. Of course, other suitable materials may be used. The base 104 includes a pivot bore 110 adapted for receiving pivot pins 86 or 88. A gear segment 112 is formed proximate an end portion 116 of finger base 104 of finger 82. Likewise, gear segment 114 is formed proximate an end portion 116 of finger base 104 of finger 84. The pivot bores 110 and pins 86 and 88 are aligned on the support member or frame 80 such that gear segment 112 meshes with gear segment 114 (see FIG. 6). Of course each gear segment may be manufactured as a separate piece and welded or otherwise attached by known means to the finger base 104.

One end of the actuator 102 is rotationally attached to the finger base 104 of finger 82, a predetermined offset distance away from the pivot axis of finger 82, to provide for the proper rotation of finger 82 and also reduce the amount of linear force required to rotate finger 82. The other end of the actuator 102 is rotationally attached to the support member 80. As the finger 82 is rotated via the force provided by actuator 102, the meshed gears 112 and 114 cause finger 84 to simultaneously rotate in the opposite direction. In this manner, the fingers 82 and 84 may be actuated to converge towards each other or diverge away from the other (see FIGS. 4 and 5). Without limitation, although the fingers 82 and 84 are segmented for ease of manufacture, those skilled in the art will recognize that fingers 82 and 84 could be manufactured as one continuous member.

The middle 106 segment of each finger 82 and 84 is provided for support and links the finger base 104 to the tip 108. The tip 108 of the first finger 82 may be configured or split to form a split tip 109 such that when fingers 82 and 84 converge, the tip of finger 84 passes between a gap 118 formed by the split tip 109 of finger 82 (see FIG. 5). The outer end of each tip 108 includes a guide roller 94 or 96 which operates to gently address and urge containers of a plurality of different shapes inward toward the support member 80.

Each finger 82 and 84 has attached thereto a flexible element or belts 90 and 92 respectively. One end of each belt is attached adjacent an outer end of the tip segment 108, while the other end of each belt 90 and 92 is attached adjacent the end portion 116 of the finger base 104. A middle portion of each belt 90 and 92 is retained proximate each corresponding finger 82 and 84 by respective belt guides 98 and 100. A central end portion of belt 90 is removed to thereby conform with the configuration of the split tip 109 of finger 82. The flexible belts 90 and 92 are loosely attached to accommodate and engage various shaped objects while remaining close to the respective finger to avoid entanglement of the belts. The flexible belts 90 and 92 may be constructed from any of several known materials including a steel or synthetic fiber belted composite.

Figure 8:
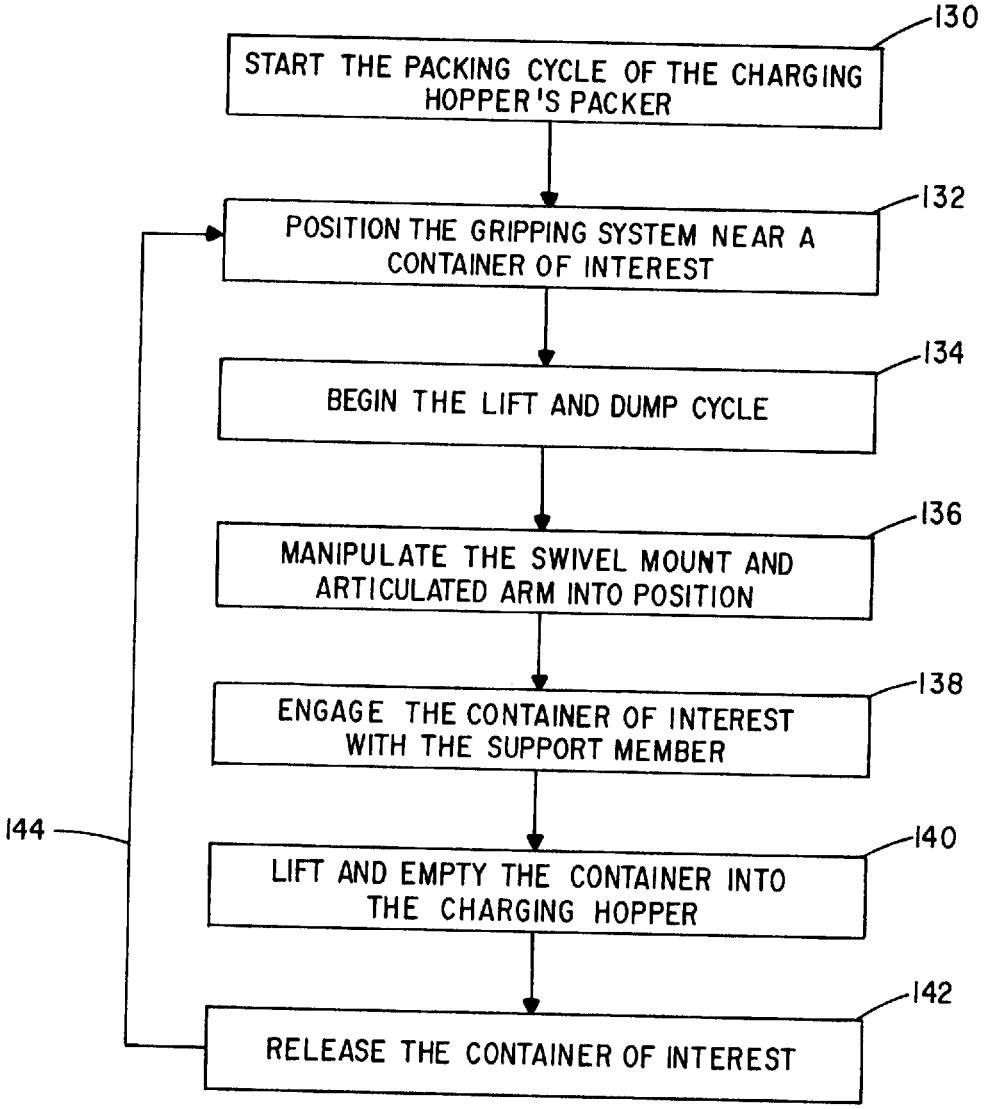
FIG. 8 is a flowchart showing the method of emptying containers of interest using the gripping device of the present invention.

Having described the functional features of the present invention the normal operation of the gripping device will next be described. For exemplary purposes and without limitation, the use of the gripping device will be described in the context of emptying containers along a refuse collection route (see FIG. 8). The operator of the collection vehicle stops the vehicle such that the charging hopper 22 and gripping system 10 are positioned near a container of interest (see block 132). Often times there are several containers positioned side by side or stacked, all of which need to be emptied. The operator begins the collection cycle by extending the articulated arm from the "stowed" position and swivels the arm 18 and grabber 20 towards a selected container of interest (see block 134). The swivel mount 16 is pivoted in conjunction with the extension of the articulated arm 18 to move the support member 80 of the grabber 20 into engagement with the container of interest (see blocks 136 and 138). The actuator 102 is then extended, simultaneously converging the fingers 82 and 84 towards each other. In this manner, the grabber 20 is operated toward a closed position thereby grabbing the container. The flexible belts 90 and 92 of each respective finger 82 and 84, reduces the amount the container slips through the gripping fingers 82 and 84. Those skilled in the art will appreciate that the belts 90 and 92 provide added engaging area and, therefore, friction to thereby reduce the amount of gripping force required to grip the container and thereby reduce the potential of damaging the container.

Once the fingers 82 and 84 engage the container, the articulated arm 18 is operated generally vertically to lift and tip or invert the container and empty the contents into the top opening 24 of the charging hopper 22 of the collection vehicle 14 (see block 140). The container is then returned to the origination spot and released (see block 142).

The charging hopper 22 is equipped with a packer panel of known construction. The packer panel is actuated forward and aft to thereby pack the emptied contents of the container into the storage body 30 of the collection vehicle 14. In the preferred embodiment, the packer panel is actuated by high efficiency hydraulic cylinders which allows the packer panel to be actuated continuously without concern of overheating the system (see block 130). The operator continues to empty all of the containers of interest into the charging hopper 22 as the packer panel continuously cycles through the fore and aft positions (see loop 144). In this manner the operator is able to concentrate on operating the gripping system 10 without a need to also operate the packer panel.

This invention has been described herein in considerable detail in order to comply with the patent statutes and to provide those skilled in the art with the information needed to apply the novel principles and to construct and use such specialized components as are required. However, it is to be understood that the invention can be carried out by specifically different devices, and that various modifications, both as to the equipment details and operating procedures, can be accomplished without departing from the scope of the invention itself.

What is claimed is:

1. A gripping apparatus for grabbing collection containers, wherein a support member of the gripping apparatus is attached to a mechanized arm of a collection vehicle which operates between stowed, extended, lift and emptying positions, said gripping apparatus comprising:

a) first and second opposed mechanized fingers each having a proximal end and a distal end, said proximal end of each finger being pivotally connected to the support member, said first and second fingers being aligned in spaced relation and disposed to converge and diverge to grasp and release an object of interest;

b) a first belt having a proximal end attached to the proximal end of said first finger and further having a distal end attached adjacent the distal end of said first finger;

c) a second belt having a proximal end attached to the proximal end of said second finger and further having a distal end attached adjacent the distal end of said second finger;

d) wherein the distal end of said first finger is split into an upper and a lower member, such that when the second finger converges on the first finger, the second finger overlaps the first finger between the upper and lower members and wherein the distal end of said first belt is split into upper and lower elements which are aligned with said upper and lower members of said first finger; and e) a guide roller rotatable attached to the distal end of each of said upper and lower members of said first finger and said second finger beyond said first and said second belts.

2. The gripping apparatus as recited in claim 1, further comprising a means for simultaneously actuating said first and second fingers coupled to the support member.

3. The gripping apparatus as recited in claim 1, further comprising a first retainer guide attached to a mid portion of said first finger and a second retainer guide attached to a mid portion of said second finger, wherein said first retainer guide slidingly engages said first belt and said second retainer guide slidingly engages said second belt.

4. An apparatus for grabbing, lifting and emptying containers into a collection vehicle, said gripping apparatus comprising:

a) a collection vehicle and a mechanized arm connected to the collection vehicle and operable between stowed, extended, lift and dump positions;

b) a support member rotationally connected to a free end of said mechanized arm;

c) first and second opposed mechanized fingers each having a proximal and distal end, said proximal end of each finger being pivotally connected to said support member, said first and second fingers being aligned in spaced relation and disposed to converge and diverge to grasp and release an object of interest;

d) a first belt having a proximal end attached to the proximal end of said first finger and further having a distal end attached adjacent the distal end of said first finger;

e) a second belt having a proximal end attached to the proximal end of said second finger and further having a distal end attached adjacent the distal end of said second finger;

f) wherein the distal end of said first finger is split into an upper and a lower member, such that when the second finger converges on the first finger, the second finger overlaps the first finger between the upper and lower members and wherein the distal end of said first belt is split into upper and lower elements which are aligned with said upper and lower members of said first finger; and g) a guide roller rotatably attached to the distal end of each of said upper and lower members of said first finger and said second finger beyond said first and said second belts.

5. The apparatus as recited in claim 4, further comprising a means for simultaneously actuating said first and second fingers coupled to said support member.

6. The apparatus as recited in claim 4, further comprising a first retainer guide attached to a mid portion of said first finger and a second retainer guide attached to a mid portion of said second finger, wherein said first retainer guide slidingly engages with said first belt and said second retainer guide slidingly engages with said second belt.

7. A system for approaching, grabbing, lifting and tipping containers into a collection vehicle, comprising:

a) a collection vehicle and a mechanized swivel mount fixed with reference to material receiving location of the collection vehicle, and adapted for angular displacement in a first plane;

b) a mechanized articulated arm attached at one end to said swivel mount for angular displacement in said plane and having a plurality of segments disposed to pivot in a second plane which intersect said first plane, said articulated arm being operable between stowed, extended, retracted, lift and dumping positions;

c) first and second opposed mechanized fingers each having a proximal and distal end, said proximal end of each finger being pivotally connected to a support member rotatably attached to a free end of said mechanized arm, said first and second fingers being aligned in spaced relation and disposed to converge and diverge to grasp and release an object of interest, d) a first belt having a proximal end attached to the proximal end of said first finger and further having a distal end attached adjacent the distal end of said first finger;

e) a second belt having a proximal end attached to the proximal end of said second finger and further having a distal end attached adjacent the distal end of said second finger;

f) wherein the distal end of said first finger is split into an upper and a lower member, such that when the second finger converges on the first finger, the second finger overlaps the first finger between the upper and lower members and wherein the distal end of said first belt is also split into an upper and a lower element, said upper and said lower elements being aligned with said upper and said lower members of said first finger;

g) a plurality of actuator means for operating said system;

h) guide roller means rotatable attached to the distal end of each of said upper and said lower members of said first finger and said second finger beyond said first and said second belts; and i) a first retainer guide attached to a mid portion of said first finger and a second retainer guide attached to a mid portion of said second finger, wherein said first retainer guide slidingly engages with said first belt and said second retainer guide slidingly engages with said second belt.

8. The system as recited in claim 7, wherein said plurality of actuator means further comprise a means for simultaneously actuating said first and second fingers coupled to said support member.

9. The system as recited in claim 8 wherein said plurality of actuator means further comprises a single hydraulic cylinder attached to operate one of said fingers, said fingers being otherwise mechanically linked to operate in unison.

* * * * *

UNITED STATES PATENT AND TRADEMARK OFFICE

CERTIFICATE OF CORRECTION

PATENT NO. : 5,769,592
DATED : June 23, 1998
INVENTOR(S) : Ronald E. Christenson It is certified that error appears in the above-indentified patent and that said Letters Patent is hereby corrected as shown below:

In claim 1, column 6, line 64, delete "rotatable" and insert -- rotatably --.

In claim 7, section (b), column 8, line 6, after "said", insert -- first --; in line 8, delete "intersect" and insert -- intersects --; and in section (h), line 36, delete "rotatable" and insert -- rotatably --.

Signed and Sealed this

Eighteenth Day of August, 1998

Bruce Lehman

*Attest:*

BRUCE LEHMAN

*Attesting Officer*

*Commissioner of Patents and Trademarks*